United States Patent [19]

Robinson et al.

[11] 4,375,310

[45] Mar. 1, 1983

[54] SELF-LOCKING CABLE CONNECTOR

[75] Inventors: Leon H. Robinson; Jerry M. Speers; Adelber Barry, all of Houston, Tex.

[73] Assignee: Exxon Production Research Co., Houston, Tex.

[21] Appl. No.: 250,975

[22] Filed: Apr. 3, 1981

[51] Int. Cl.[3] ..... H01R 13/625; H01R 17/04

[52] U.S. Cl. ..... 339/88 R; 339/90 R; 339/177 R

[58] Field of Search ..... 339/75 R, 177 R, 88 R, 339/90 R

[56] References Cited

U.S. PATENT DOCUMENTS 3,681,739 8/1972 Kornick ..... 339/177 R X
3,694,793 9/1972 Concelman ..... 339/177 R X
3,848,950 11/1974 McCormick et al. ..... 339/90 R
3,970,355 7/1976 Pitschi ..... 339/177 R
3,982,808 9/1976 Marechal ..... 339/88 R

*Primary Examiner*—Willie G. Abercrombie
*Attorney, Agent, or Firm*—M. L. Delflache

[57] ABSTRACT

A self-locking cable connector especially useful in wireline data telemetry operations or wellbore logging comprises a plug and receptacle. A locking sleeve assembly acts to lock a key on the plug into a circumferential keyway on the receptacle, when the plug is inserted into the receptacle to form an electrical connection. Seals keep the connectors isolated from the drilling fluid which is circulated during rotary drilling. The cable connector may pass through rig sheaves and may be spooled with the cable.

3 Claims, 5 Drawing Figures

SELF-LOCKING CABLE CONNECTOR

BACKGROUND OF THE INVENTION

1. The Field of the Invention

A self-locking cable connector useful in wireline data telemetry operations or in wireline logging of boreholes is the principal focus of this invention. Although the invention preferably relates to connections for braided cable, the connector of this invention may also be used for coaxial cables or other wiring. The preferred connector of this invention is durable so that it will withstand the hostile environment of drilling fluid circulation in a rotary drilling operation.

2. A Description of the Prior Art

When wireline data telemetry operations are conducted during rotary drilling, a wireline or cable is normally extended in the drill string from a location near the drill bit to the surface. Connectors are used to connect various segments of the cable in the drill string. The corrosive power of the drilling fluids used during rotary drilling presents a problem in maintaining the integrity of these connections. The drilling fluids effect the durability of the connectors and, in some cases, seeps into the connectors to cause a loss of electrical signal. Available connectors have the disadvantage that they are too large and too inflexible either to easily pass through the sheave equipment used to pay cable in or out or to spool with the cable for storage. Also, the threaded connections of available connectors have threaded connections which sometimes unwind during the drilling operations causing a loss of electrical signal.

In the elecrical component art, Kornick (U.S. Pat. No. 3,681,739) discloses a sealed coaxial cable connector which seals the spaces of the connector that surround the connector heads. The connector preferably has a plug and a receptacle which are connected in a bayonet-type connector arrangement. Pins follow L-shaped slots, and are held under spring bias to maintain electrical contact. Concelman (U.S. Pat. No. 3,694,793) discloses a quick connect coaxial coupling using a split outer shell, latch-type coupling that releases when two tabs are pressed inwardly. Locke et al. (U.K. Pat. No. 1,289,390) discloses a plug and socket connector having a spring-loaded sleeve with a means for securing the plug. The securing means is designed to allow the plug and socket to separate upon application of a predetermined axial load.

Until recently, inventors have not focused on the complex problems associated with the use of electrical connectors in wellbore data telemetry. The connectors for data telemetry preferably are preferably simple in construction, simple in operation, durable, and reliable. These factors will facilitate their use and acceptance in the field, where system failure translates into sizeable expenses. Because wirelines must often be cut to length for each use, the connectors are preferably capable of being quickly and easily assembled and disassembled at the field site. The complete connector preferably will provide a dependable connection, especially when submersed in the hostile environment of circulating drilling mud (i.e. the connector will stay together and the connection will remain intact). The connector will preferably maintain the connection throughout all drilling operations. Furthermore, the connector preferably will be designed so that the cable it connects can be tensioned. Improvements in available connectors to provide a suitable connector for wireline data telemetry operations are still being sought by the industry.

SUMMARY OF THE INVENTION

The self-locking cable connector of this invention preferably comprises a receptacle and a plug. The receptacle has an inner sleeve. The end of the inner sleeve has an internal axial keyway and an internal circumferential keyway which intersects the axial keyway. A slot is formed in the end of the sleeve and is aligned with the axial keyway. The inner sleeve has an electrical connector mounted therein. The receptacle also has an outer sleeve which is moveably mounted on the inner sleeve and which has an axial tooth that is aligned with the axial keyway. The tooth is adapted to fit into the slot of the inner sleeve. The receptacle has a means for biasing the outer sleeve toward the end portion while maintaining the tooth in the slot.

The plug of the connector has a base having an outwardly extending key that is capable of following the keyways of the inner sleeve. The plug also has an electrical connector mounted on the base and adapted to mate with the connector of the receptable to provide an electrical connection when the plug is inserted into the receptacle. The plug is inserted into the receptacle by placing the key of the plug into the axial keyway of the receptacle and contacting the tooth of the receptacle to move it axially away from the end portion to clear the circumferential keyway. The plug is then rotated to rotate the key into the circumferential keyway whereupon the tooth is biased back in the slot to lock the key into the circumferential keyway.

Preferably the connector of this invention allows a tension to be placed across the connector. Also, preferably the connector has sealing means on the plug and receptacle to seal the connection to ambient fluid.

The connector of the present invention is simple in construction and operation and provides a durable, reliable, and efficient connection even in a hostile drilling environment. The connector is small enough that it can pass through rig sheaves when cable is payed in or out. It can be wound on the cable spools. The connector heads preferably are sealed to fluid within the receptacle. When disconnected, the plug has no cup which can catch drilling fluid. Therefore, the chance of fouled connections or short circuits is reduced. When the connector is locked in its closed or connected configuration, the locking mechanism is designed to endure the turbulent, pulsating flow of rotary drilling mud which places great stresses upon any equipment within the drill string. The locking feature substantially increases the likelihood that an electrical connection will be maintained throughout the drilling operations. Because reconnections must be made when each section of drill pipe is added to the drill string, the connector is designed to be able to undergo many reconnections with high reliability of connection. The connector can be quickly and easily assembled and disassembled. The connector of this invention reduces many problems that have troubled those in the field. It should improve the acceptability of data telemetry operations, because it improves the operational efficiency and reliability of the overall system.

A BRIEF DESCRIPTION OF THE DRAWINGS

A DESCRIPTION OF THE PREFERRED EMBODIMENT

1. The Receptacle

Figure 1:
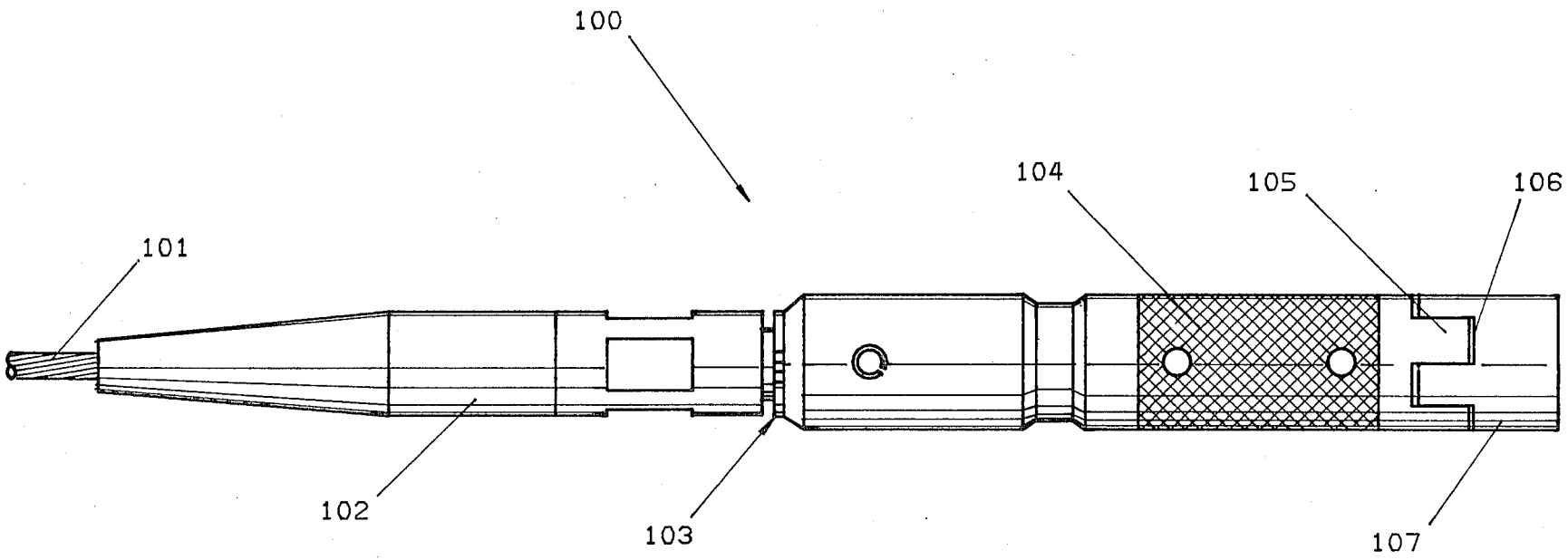
FIG. 1 shows a design drawing of a preferred receptacle of this invention.
Figure 2:
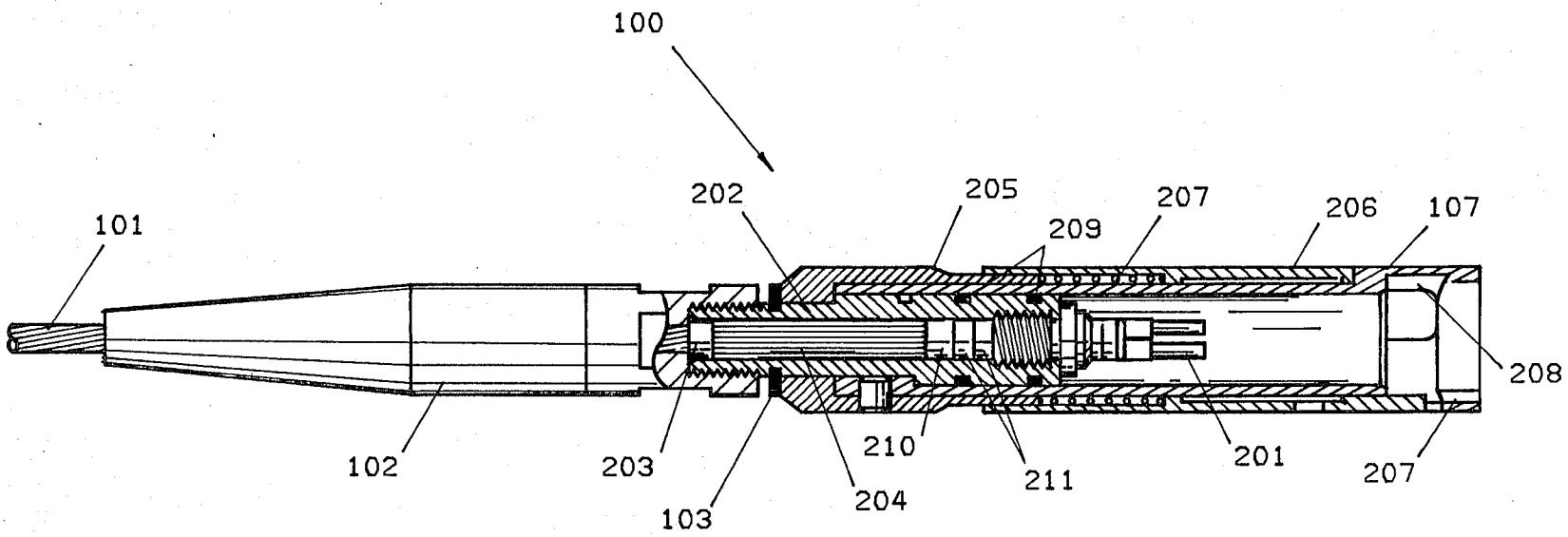
FIG. 2 shows a drawing, partially in section, showing details of the preferred construction of the receptacle of FIG. 1.
Figure 5:
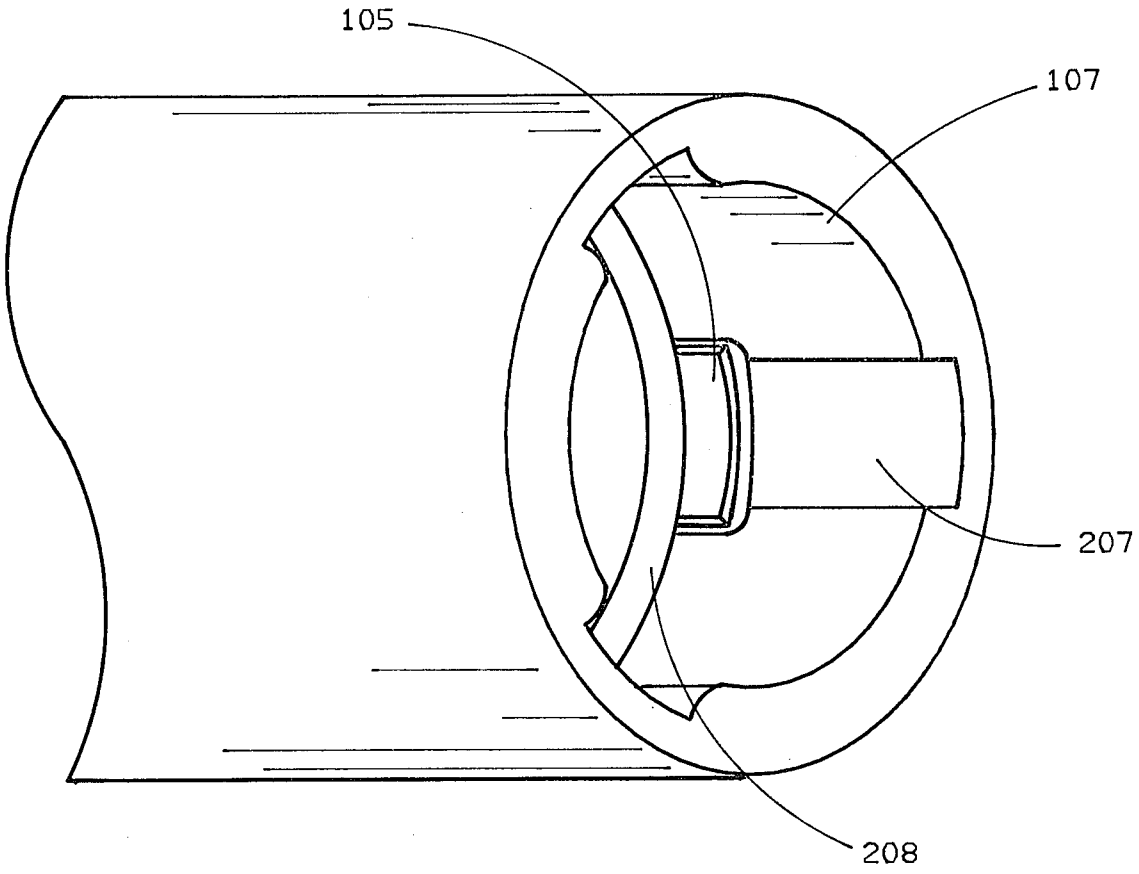
FIG. 5 shows a view of the axial and circumferential keyways in a preferred embodiment of this connector.

The self-locking cable connector of this invention may be best described by reference to the drawings. Referring to FIGS. 1, 2 and 5, the receptacle 100 preferably comprises:

a protector 102;
a retaining ring 103;
a lock sleeve assembly 104; and
an electrical connector 201.

Preferably a 3/16 inch (4.8 mm) braided conductor cable 101 enters the receptacle 100 through a protector 102. The protector 102 is preferably designed to reduce wear on the cable at the connector. It guides the cable into connection with the electrical connector 201 by means of a frustroconical, elastomeric section. The protector 102 preferably screws into the plug sleeve 202 which functions to link the cable 101 to the electrical connector 201. A retaining ring 103 fits into a slot on the plug sleeve 202. The ring 103 keeps the lock sleeve assembly 104 from moving up the cable 101. The lock sleeve assembly 104 preferably comprises an inner sleeve 205 and an outer sleeve 206. The outer sleeve 206 is movably mounted on the inner sleeve 205. Preferably the outer sleeve 206 is biased forward into abutment with an upset end portion 107 of the inner sleeve 205. A spring 207 is the preferred means for biasing. The outer sleeve 206 has at least one tooth 105 which moves in a slot 106 of the inner sleeve 205. The tooth 105 and slot 106 function to limit the circumferential rotation of the outer sleeve 206, while it guides the axial movement of the outer sleeve 206 over the inner sleeve 205. Three teeth are preferred.

The cable 101 passes through a crimp sleeve 203, which functions to hold the cable 101 in the plug sleeve 202. The crimp sleeve 203 is preferably a thin, metal tube which can be crimped around the cable 101 to hold it. The crimp sleeve 203 allows a tension to be placed across the connection while electrical continuity is maintained. It also allows the connector to be designed so that the cable will pull out of the connector before the cable breaks at some other point. To allow further strengthening of the connection, the outer braid of the cable 101 is preferably spread back over the crimp sleeve 203 before the plug sleeve 202 is forced over the end of the cable 101. Spreading back the braid exposes the central conductor wire of the braided cable 101. This central conductor extends out of the plug sleeve 202, and is soldered to the electrical connector 201 to yield a reliable connection. A packing 210 and washers 211 preferably are placed between the crimp sleeve and the connector 201. Preferably the connector 201 screws into the plug sleeve 202. When the cable 101 is tensioned, the plug sleeve 202 and crimp sleeve 203 will absorb most of the force, leaving the electrical connector 201 relatively isolated within the receptacle 100.

The plug sleeve 202 is sized to fit snugly within the lock sleeve assembly 104. Preferably O-rings 209 between the plug sleeve 202 and the inner sleeve 205 provide a fluid seal so that fluid cannot enter the receptacle 100 through the protector 102.

The inner sleeve 205 preferably has an upset end portion 107 which acts as an abutment for the outer sleeve 206 in its axial motion against the spring-bias 207 (i.e. the tooth 105 preferably abuts the end of the slot 106). The internal surface of the inner sleeve 205 has at least one axial keyway 207 bored within it. The axial keyway 207 intersects a circumferential keyway 208. When the plug 300 (see FIG. 3) is inserted into the receptacle 100, a key 301 on the plug 300 will follow these keyways. Preferably the axial keyway 207 is aligned with the tooth 105 of the outer sleeve 206. The tooth 105 is preferably sized so that it will extend into the slot 106 regardless of the position of the outer sleeve 206 on the inner sleeve 205. When the plug 300 is inserted into the receptacle 100, the plug 300 will push against the tooth 105 to move the outer sleeve backward (axially away from the upset end portion 107). This movement will open the circumferential keyway 208 so that the plug 300 can be rotated. (Preferably the axial keywway 207 ends when rotation into the circumferential keyway 208 is possible.) When the key 301 of the plug 300 moves out of abutment with the tooth 105, the tooth 105 will move forward under the spring-bias 207 toward the upset end portion 107 to lock the plug 300 into the receptacle 100 (i.e. the key 301 is locked into the circumferential keyway 208). When locked, the connector 201 of the receptacle 100 mates with the connector 302 of the plug 300 to provide an electrical connection.

2. The Plug

Figure 3:
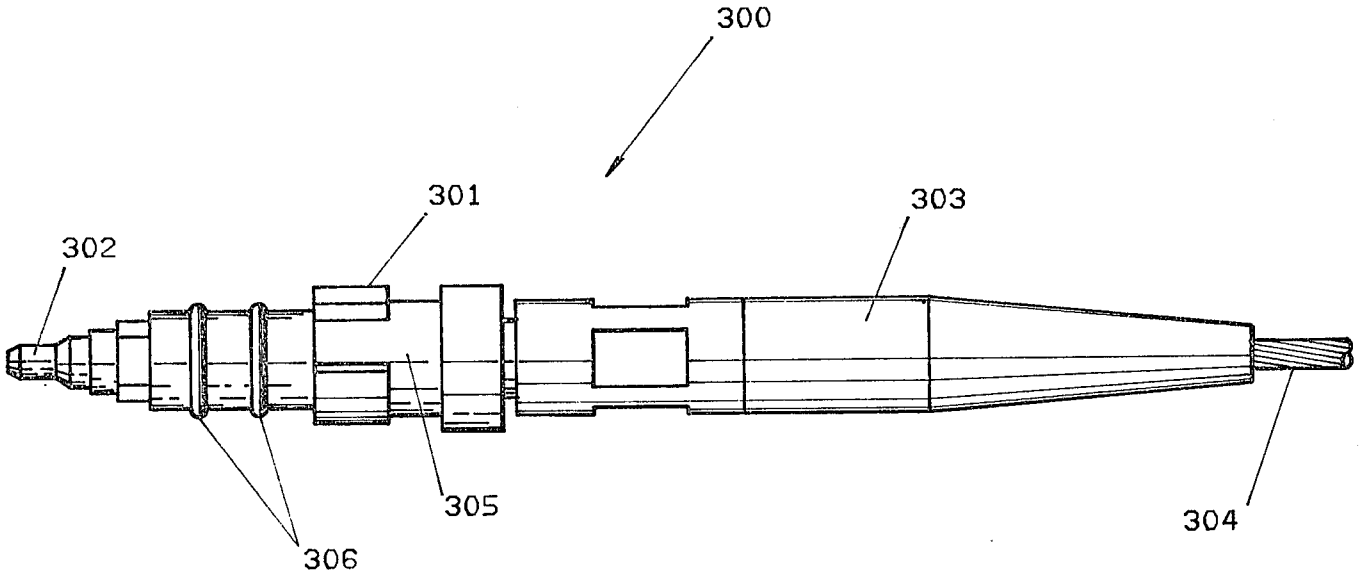
FIG. 3 shows a design drawing of a preferred plug of this invention.
Figure 4:
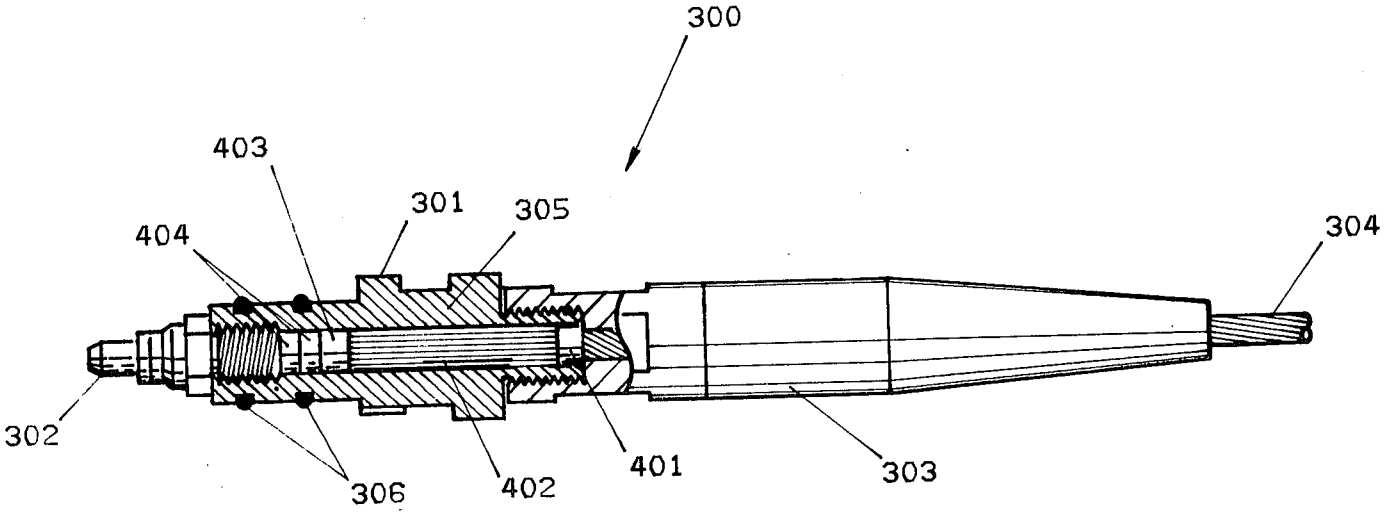
FIG. 4 shows a drawing, partially in section, showing details of the preferred construction of the plug of FIG. 3.

The plug 300 of this invention may be best described with reference to FIGS. 3 and 4. The plug 300 preferably comprises:

a base 305;
a protector 303;
a key 301;
a seal 306; and
an electrical connector 302.

The protector 303 is similar to the protector 102 for the receptacle 100. It guides the cable 304 into the base 305. As with the receptacle 100, the cable 304 of the plug 300 passes through a crimp sleeve 401. The braids 402 of the cable 304 are preferably spread back over the crimp sleeve 401 before the cable is forced into the base 305. Again, the central conductor of the cable 304 is soldered to the connector 302. Preferably a packing 403 and washers 404 cushion between the crimp sleeve 401 and the connector 302. When tension is applied to the cable 304, most of the force will be absorbed by the crimp sleeve 401 and the cable braid 402. The force necessary to pull the cable 304 away from the connector 302 will preferably be less than the break point for the cable 304.

The self-locking cable connector of this invention is designed to be used in a tensioned environment. The crimp sleeves 401 and 203 insure that the cables 304 and 101 may be tensioned. Preferably the sleeves will allow the cable to be tensioned to greater than 1000 pounds (4440 newtons) of tension without loss of connection. More preferably the connector will withstand 2000 pounds (8880 newtons) of tension without failure. It is most preferable that the connector maintain an electrical connection under a tension of 2500 pounds (11,100 newtons).

The base 305 of the plug 300 has at least one, outwardly extending key 301 which is sized to fit the keyways 207 and 208 of the receptacle. Preferably there are three keys 301 evenly spaced around the base 305 (with the corresponding number of keyways 207, slots 106, and teeth 105 on the receptacle). In the preferred embodiment shown in FIG. 5 the circumferential keyways 208 become a circular groove on the inner surface of the inner sleeve 205. Also, the base 305 preferably has seals 306 (O-rings) which are sized so that, upon insertion of the plug 300 into the receptacle 100, the seals 306 will contact the inner sleeve 205 to provide a fluid seal. That is, fluid will not pass the seals 306 through the protector 303. Thus, when connected, the plug 300 and receptacle 100 will define a volume which is sealed to fluid. The sets of seals 209 and 306 help to insure that the electrical connection will be reliable.

Preferably the connector 302 of the plug 300 is a male-type connector. The plug 300 often will be positioned to point upward when drill pipe connections are being made-up. The male connector 302 allows the plug 300 to have no cup portions which may catch drilling fluid. Therefore, the plug 300 may be readily wiped of fluid before insertion into the receptacle 100. Cup portions on the plug might collect drilling fluid, which would complicate clean-up. The reliability of the connection might be lessened. The receptacle 100 necessarily has a cup portion because the lock sleeve assembly 104 is concave. Having the female electrical connector in it provides no significantly greater complications, because it is unlikely that drilling fluid will enter and foul the receptacle 100. In drilling operations the receptacle will generally be suspended from the kelly.

The connector of this invention preferably is self-locking. To make a connection, the key 301 of the plug 300 follows the axial keyway 207 of the receptacle 100 until the key 301 contacts the tooth 105 of the outer sleeve 206. Upon further insertion, the key 301 will push the tooth 105 backward in slot 106 (axially away from the upset end portion 107 of the inner sleeve 205) to clear the circumferential keyway 208. The plug 300 is then rotated so that the key 301 moves into the circumferential keyway 208. The key 301 will slowly lose contact with the tooth 105. The tooth 105 will then move forward axially in the slot 106 under the spring-bias 207 preferably to abut, once again, against the upset end portion 107 of the inner sleeve 205. In this position, the tooth 105 locks the key 301 into the circumferential keyway 208. Moving the outer sleeve 206 backward axially will allow rotation of the key 301 and disconnection, by pulling the plug outwardly along the axial keyway 207.

While an embodiment and application of this invention have been shown and described, those skilled in the art will realize that many more modifications are possible without diverting from the inventive concepts of this specification. The invention is to be restricted only as the prior art or the spirit of the appended claims necessitates.

What is claimed is:

1. A self-locking cable connector comprising:

(a) a receptable which has:

(i) an inner sleeve having an end portion, an internal axial keyway, an internal circumferential keyway which intersects the axial keyway, and a slot in the end portion which is aligned with the axial keyway and intersects the circumferential keyway.

(ii) an outer sleeve which is moveably mounted on the inner sleeve and which has an axial tooth that is adapted to fit into the slot of the inner sleeve;

(iii) means for biasing the outer sleeve toward the end portion while maintaining the tooth in the slot; and (iv) an electrical connector mounted in the inner sleeve; and (b) a plug which has:

(i) a base having an outwardly extending key that is adapted to be inserted into the keyways of the inner sleeve; and (ii) an electrical connector mounted on the base and adapted to mate with the connector of the receptacle to provide an electrical connection when the plug is inserted into the receptacle by inserting the key into the axial keyway and contacting the tooth to move it axially away from the end portion to clear the circumferential keyway and rotating the key into the circumferential keyway.

2. A connector as defined in claim 1 wherein the connection can withstand a tension of 1000 pounds placed across the connector.

3. A connector as defined in claim 2 wherein sealing means on the plug and receptacle seal the connection to fluid.

* * * * *